United States Patent [19]

Audas

[11] 4,136,535

[45] Jan. 30, 1979

[54] PADDING APPARATUS FOR GOODS IN WEB-FORM

[76] Inventor: Francis G. Audas, 54 Earle Rd., Bramhall, Cheshire, England

[21] Appl. No.: 887,074

[22] Filed: Mar. 15, 1978

Related U.S. Application Data

[63] Continuation-in-part of Ser. No. 562,792, Mar. 27, 1975, abandoned.

[30] Foreign Application Priority Data

Apr. 8, 1974 [GB] United Kingdom ..... 15449/74

[51] Int. Cl.[2] ..... D06B 21/00; D06B 23/18

[52] U.S. Cl. ..... 68/5 E

[58] Field of Search ..... 68/DIG. 1, 5 D, 5 E, 68/6; 118/65, 67, 68; 8/149.1

[56] References Cited

U.S. PATENT DOCUMENTS

| | | | |
|---|---|---|---|
| 1,592,171 | 7/1926 | Bacher | 68/6 |
| 1,637,387 | 8/1927 | McEnaney | 68/6 |
| 2,059,881 | 11/1936 | Lane | 118/65 |
| 3,106,460 | 10/1963 | Topham et al. | 68/5 E X |
| 3,128,206 | 4/1964 | Dungler | 68/5 E X |
| 3,680,334 | 8/1972 | Erickson et al. | 68/DIG. 1 |

FOREIGN PATENT DOCUMENTS

| | | | |
|---|---|---|---|
| 277525 | 11/1964 | Netherlands | 68/5 E |

*Primary Examiner*—Philip R. Coe

*Attorney, Agent, or Firm*—Ross, Ross & Flavin

[57] ABSTRACT

The apparatus comprehends a bath and a pad liquor supply charged thereinto, a guide means disposed within the bath for guiding the goods therethrough, and a steam jacket communicating with a steam source. The jacket lies in vertical disposition upwardly of the bath and has apertured top and bottom walls. A partition disposed within the jacket suspends downwardly from and connects to the jacket top wall in registry with the aperture thereof to define a primary passage through the partition which is open at its upper end to atmosphere and open at its lower end into the jacket, through which primary passage, the goods are passed before passage into the jacket. The jacket and partition cooperantly constrain the steam flow through the jacket in a first downward flow direction exteriorly of the partition in a heat transfer relationship therewith and in a second upward flow direction interiorly of the partition through the primary passage in a direction counter to the downward direction of movement of the goods. A seal having a secondary passage extending therethrough is disposed with an upper portion extending in a sealed manner through the aperture in the jacket bottom wall and into the jacket in a vertical alignment with the partition. Its lower portion extends into the bath. The secondary passage accommodates movement of the goods in an absence of air and steam in their movement from the jacket into the bath and to and from the guide means, and outwardly of the bath.

3 Claims, 1 Drawing Figure

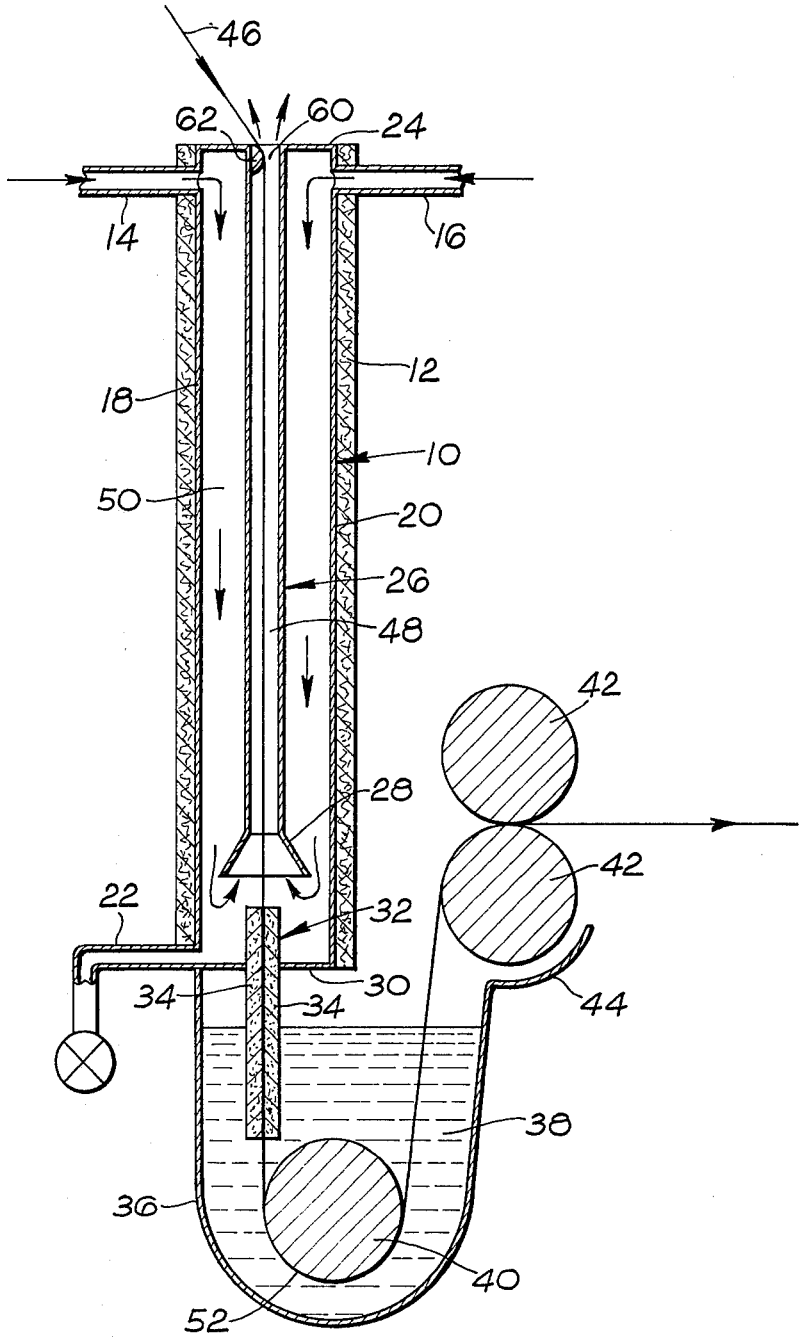
46
62
60
24
14
16
12
18
10
50
20
26
48
42
28
42
22
32
34
34
30
44
38
36
40
52

PADDING APPARATUS FOR GOODS IN WEB-FORM

This application is a continuation-in-part of the application filed by me as Ser. No. 562,792 on Mar. 27, 1975, and now abandoned.

This invention relates to improved apparatus for carrying out the impregnating of fibrous materials, as for example textiles with processing liquors, for instance dye liquors.

Woven or knitted cloth and narrow fabrics, as for example ribbons or tapes in web form, often require finishing treatments, on the order of mercerising, scouring, desizing, bleaching, dyeing and the like treatments which are commonly described as finishing treatments.

Such finishing treatments may be performed in a batch-wise fashion or continuously, and it is with the feature of continuous treatment that this invention is concerned.

Continuous finishing frequently makes use of the padding process as a method of impregnating textiles, or similar web-form goods, with liquors by passage through a pad bath and then removing the surplus liquor (normally returning it to the bath) as by mangling. The pressure on the mangle bowls is controlled with the object of obtaining a specific pick-up of dye liquor, which after a subsequent dye fixation treatment, should give a close match with a desired color.

The liquor in the pad bath may contain wetting agents, scouring agents, emulsifiers, bleaching chemicals, dyestuffs or other chemicals or reagents such as are commonly used in the finishing trade.

After the padding stage, other continuous treatments such as steaming, baking, washing, drying may follow. Additional padding stages may also be involved.

Before the cloth can be pad-dyed in this way, it is usually necessary to remove any size, wax and/or lubricant and often, also, to bleach it. One of the most important functions of these preparatory treatments is to make the cloth sufficiently absorbent so as to obtain an even impregnation of the dye liquor in the padding process. Despite these preparatory treatments, differences in absorbency, or in the rate of wetting, often still cause variations in the shade of dyed cloth.

One of the objects of the scouring and desizing treatment is to make sure that the product is easily wettable, so that one can obtain, in a subsequent padding, a homogeneous distribution of a precisely known quantity of a liquor. Despite the considerable costs of some known preparatory treatment processes, satisfactory padding with a liquor such as a dye liquor, is not always obtained.

One can achieve an improved wetting so that even loom-state cotton, and other textile materials still containing waxes, sizes and lubricants, can be substantially fully-impregnated by the padding treatment and without any need for assistance from any wetting agent or other auxiliary reagent. The resultant impregnation is generally more nearly complete and even, and the actual quantity of retained liquor is much more accurately controllable, for example by a suitable adjustment of the pressure exerted, as by the pad-mangle bowls, for removing the excess liquor.

According to my apparatus, when air is removed from cloth or other fibrous materials, by purging with steam in the manner allowed, then the effect of differences in absorbency on pick-up in a padding process become negligible and in the case of pad dyeing, therefore, no longer effect the shade of a dyed cloth.

The invention provides a structure for padding goods wherein the web is passed through a bath of pad liquor and subsequently has the surplus liquor removed therefrom, the web passing to the bath through a counter-current of steam in such manner as to prevent access of air to the web subsequent to being exposed to the steam and prior to being exposed to the pad liquor.

The web of cloth, ribbon, tape, or other similar material may be passed through a steam chamber so as to pass through a counter-current of steam being taken through such chamber. At the outlet end, a sealing arrangement of the steam chamber extends into a pad bath and sufficiently below the surface of the bath liquor to prevent access of air to the web after the steaming treatment. Steam in the chamber and the surface of the liquor of the bath, which may be arranged as a lower extension of the chamber, are separated by the provision of the seal arrangement, through which the web can readily pass, but which reduces the steam-liquid interface to a substantially negligible area.

The structure is such that the steam treatment does not cause significant wetting of the web, my purpose being not to wet the web but to strip it of air as completely as possible and to replace the stripped air by largely-uncondensed water vapour.

Following my steam treatment, the web is hot and substantially dry, being substantially free from air and containing, in the place of displaced air, only hot water vapour. My structure allows the web to be immersed in the pad liquor, with condensation of the water vapour occurring within the porous web structure so as to cause a reduction in pressure and the liquor constrained to replace it in the spaces formerly occupied within the structure.

The width of the steam chamber, through which the goods are passed through the counter current flow of steam, is preferably sufficient to allow the web to pass through in open width without creasing.

The height of the chamber or the length of passage in the steam, preferentially, is related to the rate at which the web is passed through the apparatus and the time needed for the steam to displace substantially all the air contained in the web.

It is conceivable that additional structure may be involved to provide for the web to extend in a number of passes through the steam chamber.

At right angles to the plane of the web, the space available in the steam chamber for the counter-current steam flow and for the passage of the web is preferably as small as possible, yet wide enough to permit the free passage of goods of any reasonable thickness.

With a steam chamber so made, a relatively small quantity of steam can be made to flow counter-currently to the web at a velocity sufficiently high to prevent convective circulation of the denser mixtures of steam with air expelled from the web, such mixtures being found particularly in the upper parts of the chamber, since this would otherwise reduce the efficiency with which air is stripped from the web.

The primary purpose of the steam treatment being to remove the air, it follows that the steam used may usefully be in excess of the quantity required only to raise the web to the steam temperature. Surplus steam then ensures that air already expelled from the web will be swept out of the chamber.

With the object of the treatment being to produce a web which is free from air and is also substantially dry before the subsequent passage through the pad bath, it will be understood that the steam used in the chamber preferentially shall be free from condensate spray or droplets.

Desirably the steam chamber and seal arrangement should be small enough as to be added to existing padding units without extensive modification or any need for substantial increase in necessary floor space.

Inferentially, the invention may be produced as a new construction, or also as a modification of an existing padding unit.

In British Pat. No. 1,158,284 of July 16, 1969, Patentees Fox et al disclosed that non-absorbent or hydrophobic textile materials could be evenly impregnated with aqueous liquors, if air was first removed from the material by evacuation, before bringing it into contact with the liquor. Fox et al., showed that such a method could be used for batch processing, for example with packaged yarns, or continuously, for example, in the dyeing of woven fabrics.

In contradistinction, the present invention exploits the discovery that if air is removed from fibrous materials by displacement with vapours such as steam, before treatment with processing liquors, improvements in impregnation can be obtained by means of equipment which is simple to construct and which in the case of continuous processing, does not require the use of pressurized seals.

When using my apparatus for the continuous impregnation of fibrous material, for example woven or knitted fabric, with an aqueous liquid such as dye liquor, then the material is caused to pass continuously downwardly through a chamber against an upward and counter-current flow of steam. At the bottom of the steam chamber an outlet channel is provided for the material leading directly into the processing liquor which is maintained at a level above the bottom outlet of the steaming equipment, to prevent any contact with air. To minimize condensation of live steam by contact with the processing liquor, which could lead to undesirable dilution and heating, then means may be provided to reduce the steam/liquid interfacial area within the outlet channel.

In heating cloth, or other fibrous material with steam, from approximately 20° C. to 100° C. depending on the specific heat of the material, a small amount of moisture will condense, which in the case of cellulosic materials may be approximately 6% or 7% of the cloth weight. This small amount of moisture may often be of little importance, but if necessary, this can be eliminated by preheating the material before treating with steam or alternately by treating the material with superheated steam.

After treatment with steam, the cloth or other fibrous material enters the impregnating liquor in a substantially dry state but at the temperature of the steam. Some heating of the bath will take place which will depend on the specific heat of the material, the amount of liquid removed and the temperature of the replacement liquor. Should it prove necessary, then the impregnation liquor may be cooled by the use of a water jacketed vessel, or the use of water cooled coils within the bath or by any similar means.

Steam treatments of textile materials, are of course, commonplace, but these are all fundamentally different from the structure here involved which is used only to improve the padding process. In conventional processes, textiles or other materials may be treated with liquids containing enzymes for the solubilisation of starch sizes, bleaching chemicals, or dye liquors, and any subsequent steaming treatment of the wetted goods has its purpose the heating of the wet goods to accelerate the rate of action of the enzymes or the bleaching chemicals or to assist in the fixation of dyes. Not in any way are these or other steam treatments concerned directly with improvements in padding. Many of these steaming treatments are relatively long, involving periods of one to several minutes but the only function of the steam is to supply heat under conditions in which evaporation of the previously-applied liquors used for the various treatments of the goods, is prevented or at least controlled.

The treatment allowed by my structure is different in that textiles or other similar goods are treated with the steam in the dry state before the impregnation or padding process, and the object of the steam treatment is the removal of air to ensure that the subsequent impregnation is satisfactorily achieved. The use of steam in counter-current flow to the goods being processed is a feature necessary for the efficiency of this process, and as indicated the necessary steaming times are remarkably short.

In the drawing:

The FIGURE is a diagrammatic sectional view in side elevation illustrating a preferred embodiment of the apparatus of the invention.

The apparatus comprises a steam jacket 10 substantially in the form of a vertically-disposed box of rectangular cross-sectional shape. Externally, jacket 10 is lagged with a suitable heat-insulating covering 12 to minimise heat loss. Near the upper end of the jacket, steam inlet pipes 14, 16 connect with the opposed walls 18, 20 of jacket 10. A condensate drain-off pipe 22 connects with wall 18 at the bottom thereof.

Top wall 24 of jacket 10 has a substantially centrally-disposed rectangular opening 60 therein, and secured into this is a narrow rectangular box-like partition 26 which is open at its top so as to open to atmosphere through opening 60. At its lower end, partition 26 is formed with a flared mouthpiece 28.

Set into a central aperture in the lower wall 30 is a sealing arrangement 32 comprising two rectangular slabs 34 of resilient material, such as a resilient plastics foam, faced on their confronting surfaces with respective layers of a suitable material having a low-coefficient of friction.

Jacket 10 is disposed above a pad unit comprising a pad bath structure in the form of a sectioned trough 36 containing a bath 38 of liquid with which it is desired to pad or impregnate goods in web form, for example a dye liquor.

A rotatable guide roller 40 is mounted in trough 36 in a disposition such that the plane of the confronting surfaces of slabs 34 is substantially tangential thereto. A pair of mangling rollers 42 are arranged above a gutter 44 provided adjacent the upper edge of trough 36 so as to be unobstructed by jacket 10.

The material to be impregnated with the pad liquor of bath 38 is supplied to the apparatus from above as an open-width web 46 which moves towards opening 60 at an angle and, after sliding over a guide protrusion 62 along one major side of opening 60 passes vertically downwardly through passage 48 defined by partition 26. This arrangement minimizes the possibility of steam condensing in web 46 just before it enters opening 60, the web approaching the opening at an angle so as not to pass through the emerging steam while at the same time avoiding any impeding of the steam flow.

Steam is supplied at a slight pressure above atmospheric pressure and enters jacket 10 by way of pipes 14 and 16. Thereupon it passes downwardly through exterior space 50 defined in jacket 10 by partition 26. At the bottom of jacket 10, the steam then enters passage 48 by way of flared mouthpiece 28 so that it passes upwardly within partition 26 and out the top of the latter carrying with it air expelled from the web being processed while avoiding contact with the fresh incoming web.

Simultaneously, web 46 passes downwards through passage 48 against the flow of the steam, and leaves jacket 10 by sliding between slabs 34 of sealing arrangement 32 which has its lower end disposed beneath the surface of pad liquor 38. Web 46 extends as a bight 52 around guide roller 40 and through the pad liquor, padding being completed by the resultant impregnated web passing between mangling rollers 42.

If desired, the steam emerging from the top of the apparatus through opening 60 can be ducted away.

I have found that a loom state cotton cloth, say of 4 oz. weight per square yard, and which by ordinary padding methods would be difficult to wet out, is evenly and substantially fully impregnated by pad bath 38 after steam treatment in jacket 10 of a duration as short as only one second.

Similar cloth passed through the apparatus, but with the steam switched off, was observed to be only very poorly penetrated by liquor 38 and, where the latter was a dye liquor the resultant web was patchy in appearance and more pale in overall colour than in the case where the steam was switched on.

The fact that the web needs only to be exposed to the counter-current of steam for a very short time, such as one second, indicates that, for most purposes, even for high treatment speeds, the steam treatment equipment involved in improving the padding can be acceptably small. For example, for a continuous finishing process of a lightweight cloth, involving padding at sixty yards per minute, the jacket need be only about thirty-six inches in height above the pad bath.

Cloth or other material web 46 passing into impregnating liquor bath 38, after being subjected to steaming in jacket 10, is substantially dry and at a temperature of approximately 100° C. During a continuous run, the temperature or bath 38 could alter to a temperature which may be considerably above atmospheric temperature and would be related to the rate and temperature of make-up liquor which is supplied to trough 36 to replace that which is removed by the impregnated material web. Control of the bath temperature, may, therefore, be necessary for some purposes, but this can be effected by use of cooling or heating coils or by other conventional means.

Two examples of web material treated through the use of the apparatus of the invention serve to show its usefulness.

EXAMPLE I

A sample piece of a cotton cloth of 4 ounces weight per square yard, containing size and lubricant, was padded through a water bath containing a wetting agent at a temperature of 50° C. by passing the cloth through the path in a conventional manner. Thereafter, the cloth was subjected to mangling between mangle bowls under a pressure of 18 Kilograms per linear centimeter. The cloth, so treated, upon subsequent analysis was found to contain approximately 49% by weight of water, the percentage being based upon the dry weight of the cloth, that is to say the cloth weight before treatment. A sample piece of the same cloth was subjected to a padding treatment in accordance with the invention, using the apparatus substantially as described and with the bath 38 again a bath of water containing a wetting agent, the rate of progress of the cloth through the apparatus being such that it was subjected to steam within jacket 10 for a period of one second. Analysis of this sample after treatment showed that it contained approximately 94% by weight of water, based upon the dry weight of the cloth, so that substantially full impregnation was achieved by a padding operation of remarkably short duration.

EXAMPLE II

Starting with two pieces of a curtain heading tape, taken from the same tape length, woven without the use of size but still containing cotton waxes, one of the pieces was padded by passing through a bath containing 1% by weight of the reactive dye Procion Orange MG together with sodium carbonate and a wetting agent, by passing the tape piece through the bath in conventional manner. The other or second piece was padded using the apparatus of the invention.

After mangling, both tapes were allowed to stand overnight in polythene bags to allow fixation to take place whereafter both tapes were washed and dried simultaneously. Upon examination, the first tape piece was found to be poorly dyed with the inner sides of the pockets barely stained, the pleating cords poorly penetrated, and outer surfaces patchy. In contrast the second piece, padded in accordance with the invention, was found to have been fully dyed with complete coloration of both pockets and cords and even dyeing throughout, the shade being significantly deeper than in the case of the first piece.

The invention is not confined to these examples or the details hereinbefore given, and variations may be made thereto within the scope of the following claims. The invention can be applied to fabrics made both of natural and synthetic textile materials, as well as blends thereof. For instance, we have found that it can be used effectively in the impregnation of fabrics made of synthetic fibres such as polyester or acrylic materials, as well as blends thereof with natural materials such as cotton.

I claim:

1. Padding apparatus for web-form goods comprising:

a bath structure and a bath of pad liquor charged thereinto, a guide disposed within the bath for guiding the web-form goods therethrough, a steam jacket communicating with a source of steam and having an inlet for leading steam from the source into the jacket, the jacket being in vertical disposition upwardly of the bath and having apertured top and bottom walls, a partition disposed within the jacket and connecting to the jacket top wall in registry with the aperture thereof and suspended downwardly from the top wall and having a primary passage extending therethrough and open at its upper end to atmosphere and open at its lower end into the jacket, the primary passage accommodating downward movement of the web-form goods therethrough and into the jacket, the jacket and partition cooperantly constraining steam flow through the jacket in a first flow direction downwardly and exteriorly of the partition in heat transfer relationship therewith and in a second flow direction upwardly and interiorly of the partition through the primary passage in counter direction to the downward direction of movement of the web-form goods, and a seal having a secondary passage extending therethrough and being disposed with an upper portion extending in a sealed manner through the aperture in the jacket bottom wall and into the jacket in vertical alignment with the partition and with a lower portion extending into the bath, the secondary passage accommodating movement of the web-form goods in an absence of air and steam in movement from the jacket into the bath and toward the guide.

2. In the apparatus as set forth in claim 1, the sealing means comprising two slabs of resilient material closely confronting each other for pressing on the web passing therebetween.

3. In the apparatus as set forth in claim 2, each of the confronting faces of the two slabs being faced with a low friction material.

* * * * *